US008162183B2

(12) United States Patent
Koenig et al.

(10) Patent No.: US 8,162,183 B2
(45) Date of Patent: Apr. 24, 2012

(54) DISPENSING DEVICE FOR MEDIA

(75) Inventors: Peter Koenig, Rielasingen (DE); Peter Stadelhofer, Singen (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 456 days.

(21) Appl. No.: 12/455,054

(22) Filed: May 28, 2009

(65) Prior Publication Data

US 2009/0294476 A1 Dec. 3, 2009

(30) Foreign Application Priority Data

Jun. 2, 2008 (DE) ..... 10 2008 027 147

(51) Int. Cl.

| | |
|---|---|
| ***B65D 50/06*** | (2006.01) |
| ***B65D 50/02*** | (2006.01) |
| ***B67D 7/06*** | (2010.01) |
| ***B67D 7/34*** | (2010.01) |
| ***B67D 7/32*** | (2010.01) |
| ***B67D 7/60*** | (2010.01) |
| ***B67B 1/00*** | (2006.01) |
| ***B65D 55/02*** | (2006.01) |

(52) U.S. Cl. ..... 222/153.13; 222/153.09; 222/153.1; 222/182; 215/216

(58) Field of Classification Search ..... 222/153.01, 222/153.02, 153.03, 153.04, 153.09, 153.1, 222/153.13, 153.14, 182, 383.1; 215/201, 215/207, 208, 213, 215, 216

See application file for complete search history.

(56) References Cited

U.S. PATENT DOCUMENTS

| | | | | |
|---|---|---|---|---|
| 3,044,648 | A | 7/1962 | Cohn | |
| 4,056,209 | A | 11/1977 | Winkler et al. | |
| 4,962,868 | A | 10/1990 | Borchard | |
| 5,226,563 | A * | 7/1993 | Coggiola | 222/95 |
| 5,335,823 | A * | 8/1994 | Fuchs et al. | 222/36 |
| 6,364,166 | B1 | 4/2002 | Ritsche et al. | |
| 6,578,741 | B2 * | 6/2003 | Ritsche et al. | 222/153.13 |
| 2001/0016701 | A1 | 8/2001 | Fuchs | |
| 2006/0016833 | A1 * | 1/2006 | Greiner-Perth | 222/383.1 |
| 2008/0105253 | A1 | 5/2008 | Pearson et al. | |
| 2008/0116223 | A1 * | 5/2008 | Stradella | 222/162 |

FOREIGN PATENT DOCUMENTS

| | | | |
|---|---|---|---|
| DE | 197 53 147 | A1 | 6/1999 |
| EP | 0 334 349 | A1 | 9/1989 |
| EP | 1 002 737 | A1 | 5/2000 |
| EP | 1 051 262 | B1 | 11/2000 |
| EP | 1 123 873 | A2 | 8/2001 |
| WO | WO2005/087299 | A1 | 9/2005 |

* cited by examiner

OTHER PUBLICATIONS

Office Action from German Patent Office dated Mar. 18, 2009 (4 pages). Search report of European Patent Office dated Aug. 3, 2009 (6 pages).

*Primary Examiner* — Darren W Gorman

(74) *Attorney, Agent, or Firm* — Flynn, Thiel, Boutell & Tanis, P.C.

(57) ABSTRACT

The invention relates to a dispensing device for a preferably liquid or pulverulent medium, preferably for a pharmaceutical medium, having a housing, a media store for accommodating the medium, a dispensing opening for discharging the medium, and an actuating handle which, by relative movement in relation to the housing, can bring about a dispensing operation. The housing has a removable protective covering by which the actuating handle or the dispensing opening is covered in a storage state, wherein, in the storage state, the protective covering is connected to the housing by a coupling device, and the coupling device can be uncoupled by engagement of at least one functional portion of the dispensing device, it being possible for the functional portion to be moved in relation to the housing and the protective covering.

8 Claims, 2 Drawing Sheets

DISPENSING DEVICE FOR MEDIA

APPLICATION AREA AND PRIOR ART

The invention relates to a dispensing device for a preferably liquid or pulverulent medium, preferably for a pharmaceutical medium, having a housing, a media store for accommodating the medium, a dispensing opening for discharging the medium, and an actuating handle which, by relative movement in relation to the housing, can bring about a dispensing operation.

Dispensing devices of the type in question are sufficiently known from the prior art. They serve, in particular, for discharging pharmaceutical media which are present in liquid form in the media store.

In order to prevent undesired dispensing of the medium in a storage state, in which it is not yet intended to dispense the medium, it is known from EP 1051262 B1 to provide a covering cap over the dispensing opening. EP 1051262 B1 also discloses that the covering cap can also be utilized, at the same time, in order to prevent undesired actuation of the actuating handle. The actuating handle can thus be moved in relation to the housing only when the protective cap has been removed.

OBJECT AND SOLUTION

It is an object of the invention to provide an alternative configuration which effectively prevents undesired actuation, in particular actuation by children playing with the device.

This is achieved according to the invention by a removable protective covering which is provided on the housing and by means of which the actuating handle or the dispensing opening is covered in a storage state, wherein, in the storage state, the protective covering is connected to the housing by means of a coupling device, and wherein the coupling device can be uncoupled by engagement of at least one functional portion of the dispensing device, it being possible for the functional portion to be moved in relation to the housing and the protective covering.

In the case of a protective cap over the actuating handle, this protective cap is designed such that it covers the actuating handle against access from the outside in such a way that it is not possible for the actuating handle to be forced in an actuating direction as long as the protective cap has not been removed. For this purpose, the protective cap preferably covers the actuating handle all the way round. In the case of a protective cap over the actuating handle, the protective covering preferably covers only the actuating handle itself without further constituent parts, such as the dispensing opening in particular, being covered as well. This means that the protective covering may be of a small and straightforward configuration. This configuration is advantageous in particular in dispensing devices in which the actuating handle and the dispensing opening are arranged on opposite sides of the dispensing device. A further advantage resides in the fact that existing concepts of dispensing devices can be supplemented particularly straightforwardly by the protective coverings according to the invention for the actuating handle.

In the storage state, the protective covering is coupled to the housing, wherein the housing, in the context of this invention, encloses all those parts of the dispensing device which are fixed in place relative to one another and relative to the dispensing opening.

In the case of a protective cap over the actuating handle, the protective covering ensures that accidental actuation of the actuating handle is avoided. With a configuration in which the protective covering is coupled to the housing in a child-proofed manner, this also prevents children who are playing with the device from being able to actuate the same. It is only once the protective covering has been removed that the actuating handle can be moved in relation to the housing in order to bring about a dispensing operation.

In the case of a protective cap over the dispensing opening, the design is preferably such that, with the protective cap placed in position, it is not possible for any medium to pass through the dispensing opening to the surroundings. Even if, in the case of a configuration of the protective cap over the dispensing opening, the device is actuated for example by children playing with it, it is nevertheless ensured that the children do not come into contact with the medium.

The functional portion provided for uncoupling purposes is part of the dispensing device, but can be moved in relation to the housing thereof and the protective covering. The functional portion is designed here, for example, as a separate component which is supplied as part of the dispensing-device set. As an alternative, the functional portion is such that it is fixed to a further constituent part of the dispensing device which is separate from the housing and the actuating handle.

For the purpose of uncoupling the protective covering from the housing, this functional portion is moved into a position which is envisaged for this purpose and in which it uncouples the protective covering from the housing. The functional portion preferably serves for releasing a latching connection between the protective covering and the housing. The use of the functional portion is comparable with the use of a key for opening a lock. Such a configuration poses no problem to an adult patient, whereas children are not usually capable of utilizing a functional portion acting as a key, and the dispensing device thus cannot be transferred into a use state in which the actuating handle and the dispensing opening are freely accessible. The coupling between the covering and housing in the storage state is designed such that uncoupling is possible solely using the functional portions belonging to the dispensing device and without any need for any additional tool not belonging to the dispensing device.

The coupling device is preferably arranged inaccessibly within the housing. The housing here contains at least one first aperture into which the functional portion can be pushed for uncoupling purposes. Arranging the coupling device at an inaccessible location within the housing prevents direct uncoupling of the coupling means without use of the functional portion. Furthermore, the coupling means are also hidden from view as a result, so that the functioning method is not immediately visible. This makes it difficult for children, without using the functional portion, to transfer the dispensing device into a use state.

It is particularly preferred here if the coupling device is designed such that it can be uncoupled only by the engagement of at least two functional portions, the housing containing at least two first apertures into which the functional portions can be pushed for uncoupling purposes. This configuration, in which two functional portions have to be used simultaneously and in coordinated fashion in order to uncouple the protective covering and thus to make it possible for the dispensing device to be transferred into a use state, renders handling for children significantly more difficult.

In a configuration with two functional portions, the latter are preferably part of a common, single-part, in particular single-piece component, in which case the relative position of the functional portions in relation to one another is defined as a result. This makes it easier, using the intended functional portions, to transfer the dispensing device into an uncoupled state since the functional portions can be handled jointly.

The functional portion or the functional portions is or are preferably designed as elongate elements which in particular preferably have a length of at least 3 mm in the direction in which they are introduced into the corresponding apertures, in which case uncoupling cannot be achieved using fingernails or the like.

In a development of the invention, the first aperture or the first apertures is or are designed such that it is not possible for the coupling device to be reached without tools being used, the first aperture or the first apertures, for this purpose, preferably having a free diameter of not more than 6 mm.

For this purpose, the apertures may be of either a shape or size which is unsuitable for fingers, in particular children's fingers. A configuration which is particularly advantageous is one in which the cross-sectional surface area of the first aperture has a minimal free diameter of not more than 6 mm, in particular of not more than 4 mm. These dimensions prevent the fingers of children's hands from passing through the apertures. In accordance with a particularly preferred shaping of the apertures, the latter are of a slot-like design and preferably have a slot width of less than 4 mm, in particular less than 3 mm.

It is particularly preferred if the functional portion or the functional portions is or are provided on a cap which, in the storage state of the dispensing device, covers the dispensing opening or the actuating handle. In the case of the actuating handle having a covering which can be uncoupled by means of the functional portions, the functional portions are thus provided on a cap which covers the dispensing opening. In the case of the dispensing opening having a covering which can be uncoupled by means of the functional portions, the functional portions are provided on a cap which covers the actuating handle. Rather than having to be supplied as separate components along with the dispensing device, the functional portions, instead, are provided on the abovementioned cap, in particular are integrally formed thereon. For intended use of this configuration, the cap is removed from the dispensing device and brought back into operative connection again with the dispensing device in a different orientation, predetermined by the corresponding apertures and/or the coupling device, in order for the coupling device to be uncoupled.

It is particularly preferred here if, in the storage state of the dispensing device, the functional portion or the functional portions is or are arranged in a second aperture or second apertures of the housing. This means that, on the one hand, it is also the case that the functional portions cannot be seen in the storage state, this being advantageous in terms of esthetics, and, on the other hand, the functional portions also perform an advantageous function in the storage state by securing the cap in position on the housing.

It is advantageous, in particular, if the functional portions each have a latching nose or latching edge which, with the cap placed in position, interact with corresponding latching means on the housing, this making it difficult for the cap to be removed and/or preventing the cap from falling off accidentally.

In respect of the coupling means, it is considered to be particularly preferred if these are designed as latching means and have at least one latching nose which can be deflected out of its latching position by the functional portion. Latching means constitute a particularly straightforward form of a coupling device which can only be uncoupled with difficulty, if at all, without tools being used. In particular they are particularly suitable, for example as a result of corresponding slopes on the latching noses, for being uncoupled by a functional portion which can be pushed in in a translatory manner.

It is particularly preferred if the latching noses are provided along the protective covering and, in the storage state, interact with a latching edge on the housing in order to achieve the coupled state.

BRIEF DESCRIPTION OF THE DRAWINGS

Further advantages and features of the invention can be gathered from the claims and from the following description of a preferred exemplary embodiment of the inventions, which will be explained hereinbelow with reference to the drawings, in which:

DETAILED DESCRIPTION OF THE EXEMPLARY EMBODIMENTS

Figures 1A, 1B, 1C, 1D, 1E:
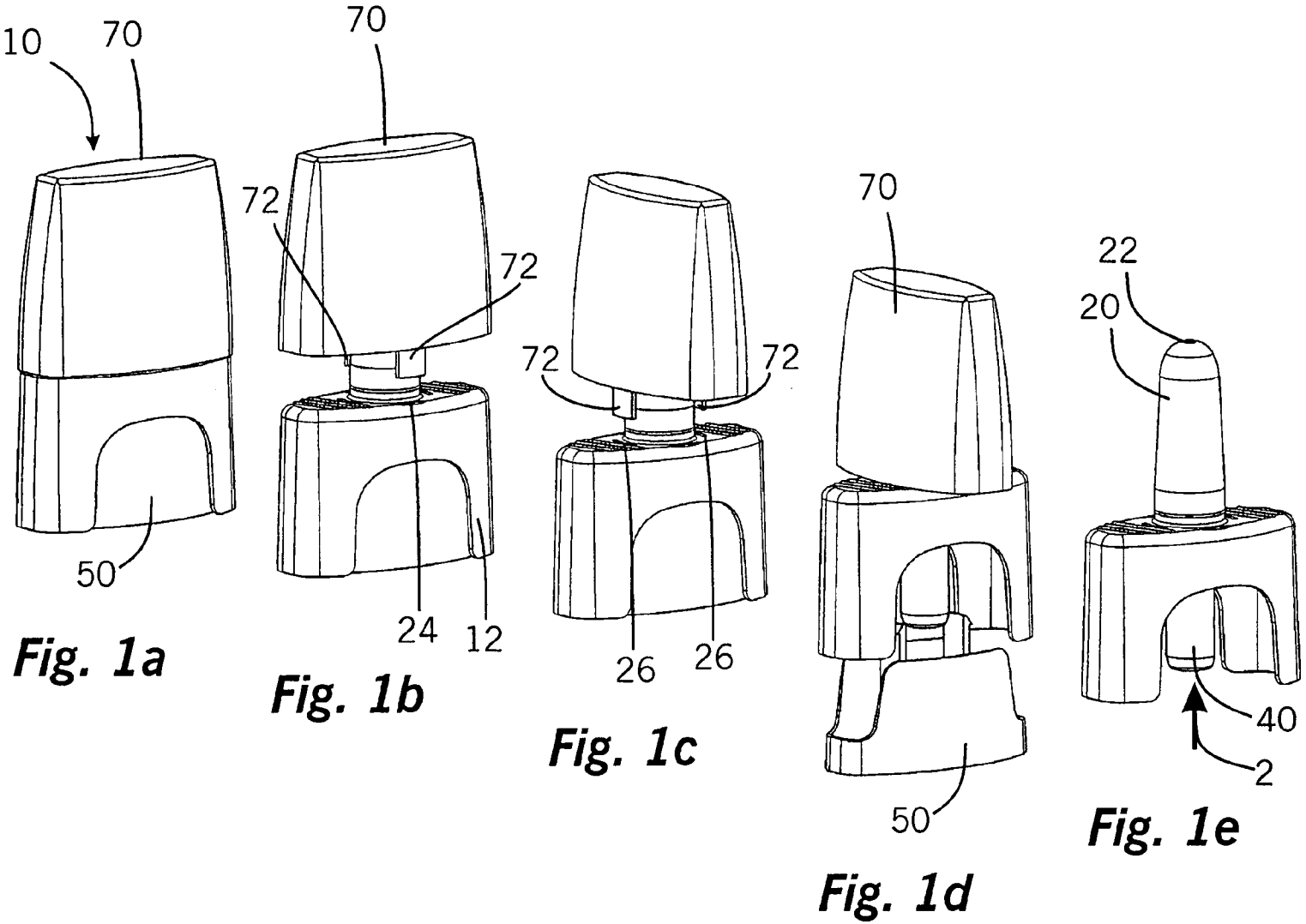
FIGS. 1*a* to 1*e* show the sequence for transferring one embodiment of a dispensing device according to the invention from a storage state into a use state.

FIGS. 1*a* to 1*e* show one embodiment 10 of a dispensing device according to the invention as it is transferred from a storage state in FIG. 1*a* into a use state in FIG. 1*e*.

In the storage state of FIG. 1*a* , the dispensing device 10 is closed by a cap 70 and a protective covering 50. The cap 70 here covers a nosepiece 20 having a dispensing opening 22. The protective covering 50 covers an actuating handle 40. In this storage state of FIG. 1*a*, it is thus the case that both the actuating handle 40 and the outlet opening 22 are not accessible, and this prevents children from getting to the medium stored in the dispensing device 10.

In order to transfer the dispensing device 10 into the use state of FIG. 1*e*, in the first instance the protective cap 70 is pulled off. As can be seen from the illustration of FIG. 1*b*, a bottom periphery of the protective cap 70 is provided with two extensions 72 which, when the protective cap is pulled off, are pulled out of apertures 24 in the housing and, as transfer continues, serve as functional portions 72 for uncoupling the protective covering 50. In the storage state of FIG. 1*a*, these functional portions 72 help to secure the cap 70 on the housing 12.

Whereas the protective cap 70, as can be seen in FIG. 1*b*, can be released from the housing simply by being pulled off, the protective covering 50 remains blocked, in the first instance, by a latching mechanism (not illustrated specifically) and cannot be released from the housing 12.

In order for it to be possible to remove the protective covering 50, the cap 70, once separated from the housing 12, is placed in position on the housing 12 again, this time in a state in which it has been rotated through 90°, in which case, rather than engaging in their original apertures 24, the functional portions 72, instead, engage in different apertures 26, which are spaced apart from these apertures 24 by an angle of 90°.

In this engaged state, which is illustrated in FIG. 1*d*, the functional portions 72 uncouple the protective covering 50 from the housing 12, in which case the protective covering 50, as can be seen in FIG. 1*d*, can be pulled off from the housing 12.

The cap 70 is then also removed again, and the use state, illustrated in FIG. 1*e*, is therefore reached. In this use state, a dispensing operation can be brought about by virtue of the actuating handle 40 being forced in the direction of the arrow 2.

The movement sequence illustrated can be carried out to good effect with a low level of force being applied, and thus also by elderly patients. However, the need for pushing the functional portions 72 into the apertures 26 in order to separate the protective covering 50 from the housing 12 is one which is difficult for children to work out on account of the complexity. The risk of children being able to transfer the dispensing device from FIGS. 1*a* to 1*e* into the use state of FIG. 1*e* is therefore low.

Figure 2:
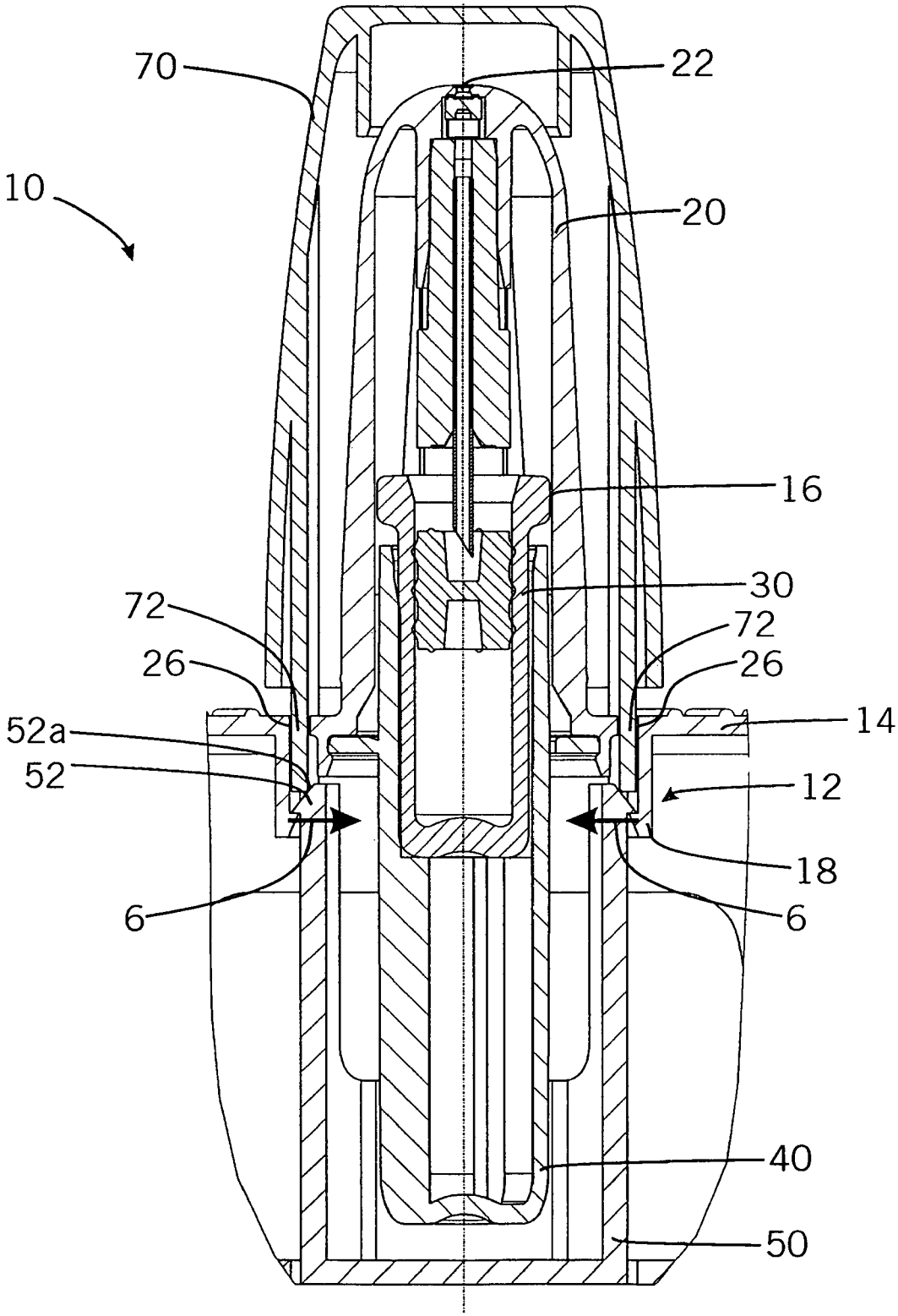
FIG. 2 shows the embodiment from FIGS. 1*a* to 1*e* in a sectional illustration.

FIG. 2 shows the construction of the described dispensing device in a sectional illustration. The latter illustrates an intermediate state between the phase of FIG. 1*c* and the phase of FIG. 1*d*, in which the uncoupling of the protective covering 50 by the functional portions 72 has not yet been achieved, but is imminent.

It can be seen that the housing 12, alongside the nosepiece 20, has a finger support 14 and a guide channel 16, it being possible for a media store 30, for the purpose of dispensing media, to be displaced in the guide channel 16, in the direction of the nosepiece 20, by means of the actuating handle 40.

The coupling between the protective covering 50 and the housing 12 is realized by latching noses 52 on lugs of the protective covering 50, these latching noses being secured on an inwardly directed stop ring 18 of the housing by snap-fitting behind the same. It can be seen that, on account of this latching, the protective covering 50 cannot be released in an intact state simply by virtue of the protective covering 50 being pulled off. Instead, the functional portions 72, which have already been described above in relation to FIG. 1*d*, are pushed through the openings 26 in the region of the finger support 14 until they come into contact with the latching noses 52 of the protective covering 50. Since these latching noses 52 each have an oblique surface 52*a*, the functional extensions 72 are able to slide along these latching noses 52, causing them to be bent inward in the direction of the arrow 6. In this inwardly bent state, the latching noses 52 are no longer in engagement with the retaining ring 18, and this therefore makes it possible for the protective covering 50 to be pulled off, as is illustrated in FIG. 1*d*.

In the case of an alternative embodiment which has not been illustrated, the functionality of the cap 70 and of the protective covering 50 is swapped over. In the case of this alternative configuration, the protective covering coupled to the housing is provided over the dispensing opening. In order for this protective covering over the dispensing opening to be removed, the cap, which has previously been arranged over the actuating handle, has to be removed and, rotated through 90°, forced in the direction of the actuating handle again, in which case functional portions arranged on the cap engage in the corresponding apertures on the underside and thus uncouple the protective covering over the dispensing opening from the housing, this allowing the protective covering then to be removed.

The invention claimed is:

1. A dispensing device for a liquid or pulverulent medium comprising:

a housing having a removable protective covering;

a media store for accommodating the medium;

a dispensing opening for discharging the medium; and an actuating handle for bringing about a dispensing operation by relative movement in relation to the housing, the actuating handle being covered in a storage state by means of the removable protective covering, wherein, in the storage state, the protective covering is connected to the housing by means of a coupling device, and the coupling device can be uncoupled by engagement of at least one functional portion of the dispensing device, the at least one functional portion being movable in relation to the housing and the protective covering.

2. The dispensing device according to claim 1, wherein the coupling device is arranged inaccessibly within the housing, and the housing contains at least one first aperture into which the at least one functional portion can be pushed for uncoupling purposes.

3. The dispensing device according to claim 1, wherein the coupling device can be uncoupled by the engagement of at least two functional portions, and the housing contains at least two first apertures into which the at least two functional portions can be pushed for uncoupling purposes.

4. The dispensing device according to claim 2, wherein the first aperture is designed such that it is not possible for the coupling device to be reached without tools being used.

5. The dispensing device according to claim 1, wherein the at least one functional portion is provided on a cap which, in the storage state of the dispensing device, covers the dispensing opening.

6. The dispensing device according to claim 1, wherein in the storage state of the dispensing device, the at least one functional portion is arranged in a second aperture or second apertures of the housing.

7. The dispensing device according to claim 1, wherein the coupling device is designed as latching means and has at least one latching nose which can be deflected out of a latching position by the at least one functional portion.

8. The dispensing device according to claim 4, wherein the first aperture has a free diameter of not more than 6 mm.

* * * * *